United States Patent [19]

Jaffee et al.

[11] Patent Number: 4,902,355

[45] Date of Patent: Feb. 20, 1990

[54] METHOD OF AND A SPRAY FOR MANUFACTURING A TITANIUM ALLOY

[75] Inventors: Robert I. Jaffee, Palo Alto, Calif.; Herbert H. Puschnik, Kapfenberg, Austria; Johann Fladischer, Kapfenberg, Austria; Johann Mayerhoffer, Tragoss, Austria; Heimo Jager, Bruck/Mur, Austria

[73] Assignee: Bohler Gesellschaft m.b.H., Kapfenberg, Austria

[21] Appl. No.: 238,050

[22] Filed: Aug. 30, 1988

[30] Foreign Application Priority Data

Aug. 31, 1987 [AT] Austria ..... 2181/87

[51] Int. Cl.[4] ..... C22F 1/18

[52] U.S. Cl. ..... 148/11.5 F; 148/12.4; 148/12.7 B; 148/18; 148/20.3; 148/20.6; 148/133

[58] Field of Search ..... 148/12.4, 12.713, 11.5 F, 148/18, 20.3, 20.6, 133

[56] References Cited

U.S. PATENT DOCUMENTS

| | | | |
|---|---|---|---|
| 3,649,374 | 3/1972 | Chalk | 148/12.7 B |
| 4,053,330 | 10/1977 | Henricks et al. | 148/12.7 B |
| 4,098,623 | 7/1978 | Ibaraki et al. | 148/11.5 F |
| 4,110,092 | 8/1978 | Kunioka et al. | 148/20.6 |
| 4,136,527 | 1/1979 | Käding | 148/20.6 |

FOREIGN PATENT DOCUMENTS

| | | | |
|---|---|---|---|
| 0003913 | 1/1985 | Japan | 148/11.5 F |
| 1204359 | 9/1986 | Japan | 148/11.5 F |
| 1217563 | 9/1986 | Japan | 148/12.7 B |
| 2074062 | 4/1987 | Japan | 148/11.5 F |
| 2170415 | 7/1987 | Japan | 148/20.6 |
| 3130755 | 6/1988 | Japan | 148/12.7 B |

OTHER PUBLICATIONS

Stranggie Ben, (ed) Schwarzmaier, Berliner Union Stuttgart, 1957, pp. 77, 97.

Secondary Cooling in Continuous Casting and its Influence on Solidification Parameters, Holzgruber, Steel Times, vol. II, No. 5, 1966, p. 219.

Continuous Casting Development, Tarmann, Iron and Steel Engineer, Dec. 1972, pp. 1–3.

Alternating Electromagnetic Fields in the Continuous Casting of Steel, Tarmann, Journal of Metals, Oct. 1966, pp. 1–6.

Continuous Casting of Round Steel Sections, Tarmann, Journal of Metals, May 1964, pp. 61–66.

*Primary Examiner*—Upendra Roy

*Attorney, Agent, or Firm*—Fleit, Jacobson, Cohn, Price, Holman & Stern

[57] ABSTRACT

A method of manufacturing a titanium alloy, wherein a melted and possibly preformed part is annealed to set the starting grain structure, wherewith a first grain structure transformation is accomplished by a first cooling step, whereafter high dislocation densities are produced in the course of a hot forming step, whereupon heat treatment involving a recrystallization is carried out, wherewith in the course of a subsequent cooling a predominantly or substantially martensitic breakdown is achieved, wherewith a grain structure transformation is carried out in a subsequent annealing process, and wherewith in the course of a subsequent chilling a fine grain structure is set. At least the first cooling step is accomplished by spraying the preformed part with water and/or water-air mixtures. A spray device may be used for carrying out the method.

20 Claims, 3 Drawing Sheets

METHOD OF AND A SPRAY FOR MANUFACTURING A TITANIUM ALLOY

TECHNICAL FIELD

The invention relates to a method of manufacturing $\alpha+\beta$ titanium alloy either in the form of a blank or as preform parts with a content of about six percent by weight of Aluminum, about four percent by weight of Vanadium, and the impurities necessarily associated with the process, wherewith the molten alloy (which may be in the form of a blank or preform parts) is annealed at a 1040°-1060° C. to stabilize the $\beta$-phase, possible after a preforming (e.g., a forging) to produce through such annealing a preform grain structure with a lamellar matrix comprised of $\alpha+\beta$ phase, wherewith the grain structure is converted to fine lamellar $\alpha+\beta$ or $\alpha'$ ($\alpha'$ being a very fine $\alpha+\beta$) in a first cooling, after which in the course of a hot forming with a degree of deformation of at least 60% at about 850°-960° C. (or a temperature about 30°-50° C. below the transition (transitus or transus) temperature of the alloy), possibly 980°-1000° C., a high dislocation density is produced, whereupon, possibly following a second cooling, a controlled recrystallization or grain structure setting is brought about by a heat treatment at c. 950° C., and a $\beta$-matrix with a finely divided globulitic $\alpha$-phase in a ratio of about 50%:50% is established, wherewith in the course of a subsequent cooling a substantially martensitic breakdown of the $\beta$-matrix is achieved, and wherewith in a subsequent annealing process the martensitic matrix is converted to a lamellar $\alpha+\beta$ phase.

BACKGROUND ART

It is important in known methods that a first chilling (e.g. quenching)—after the annealing by which the starting state of an $\alpha$-phase in an $\alpha+\beta$ matrix is brought about suitably rapidly from the $\beta$-phase—be carried out, so as to achieve a maximally uniform and fine crystalline grain structure in the form of martensitic $\alpha'$ grains and/or in the form of a fine lamellar $\alpha+\beta$ phase, and to avoid thermal stresses which lead to cracks. Heretofore it has not been which lead to cracks. Heretofore it has not been possible to attain an optimal grain structure in crack-free parts, due to inappropriate chilling conditions in this important chilling step, particularly in the case of a large cross section.

STATEMENT OF THE INVENTION

According to the present invention, particularly for attaining an adjustable high speed of cooling and a rapid uniform temperature decrease over the entire surface of the preform part, in order to avoid internal stresses and cracking, at least the first cooling, and possibly at least one of the subsequent cooling steps, is accomplished by spraying the preform part with water, possibly mixed with compressed air. It is preferred if, in the spray cooling of the preform part, care is taken to avoid leaving any surface region of the preform part unsprayed for more than 1 second. The spraying achieves uniform, controllable, rapid cooling over the entire surface. The technique avoids non-uniformities due to steam bubbles (the Leidenfrost phenomenon) which occur when immersion cooling is employed. Heat stress cracking is avoided as a result of the fact that the temperature decrease is uniform over the surface. The high but controllable cooling speed results in optimal grain structure transformation and stabilized microstructure setting.

This tendency is assisted by the fact that the grain structure of the material is necessarily influenced, from the locus of the surface being cooled, by the contraction due to the cooling process, and is subjected to substantial pressures which distribute themselves uniformly, which pressures tend to support a grain structure development which favors a fine grain structure. An additional factor contributing to uniform and rapid cooling is the fact that no region of the surface is left unsprayed for more than 1 second. It is also advantageous if the starting material (preferably bar-shaped) is rotated at 1–20 revolutions per minute, preferably 4–10 revolutions per minute, during the spraying, in the path of the water stream.

In order to improve the setting of the desired grain structure, it may be advantageous to carry out the spraying process intermittently, with the duration of the interruptions being selected depending on the rate of reheating of the cooled zone. Preferably the rate of cooling is adjusted by regulating the water pressure and/or the rotation speed and/or the duration of any interruptions (the latter in the event of the cooling spray process operated in an intermittent mode).

Advantageously a spray device is used for carrying out the method. The spray has a plurality, preferably at least three, of spray strips which preferably are symmetrically disposed around the holding space for the preform part which is undergoing spraying. The spray device may also have a device for rotating the (preferably bar-shaped) preform part past the spray strips. Spray devices of the type described are per se known, and have proven to the particularly well suited to achieve and adjust the necessary cooling conditions for an optimal grain structure of the above-mentioned Titanium based alloy.

The spray device also enables easier management of the other cooling steps carried out in the course of manufacturing the alloy, and in particular easier optimization of the setting of the grain structure. Thus, it is possible to carry out one, several, or all of the other cooling steps using a spray device. With the alloy described, precision of cooling is of particular importance.

The inventively attained grain structure has uniform grain distribution, with grains less than ten microns in micron diameter. The proportions of $\alpha$-phase and lamellar distribution $\beta$-phase may be about 50:50, with distribution uniform over the material.

Structurally improved starting materials such as billets, ingots, blanks, et cetera, can be produced by the disclosed method. Examples of end products are turbine blades, airframes for aircraft and spacecraft, screws and bolts, and particularly for structural parts subject to fatigue stressing.

This method enables starting materials to be produced which have a desired grain structure even with dimensions of individual workpieces being much larger than those customary, because the high cooling rate and accurate control achievable enable the proper treatment of, for example, preform parts having larger diameters.

BRIEF DESCRIPTION OF DRAWINGS

The drawings illustrate exemplary embodiments of the inventively employable spray devices.

DETAILED DESCRIPTION OF INVENTION

Figure 1:
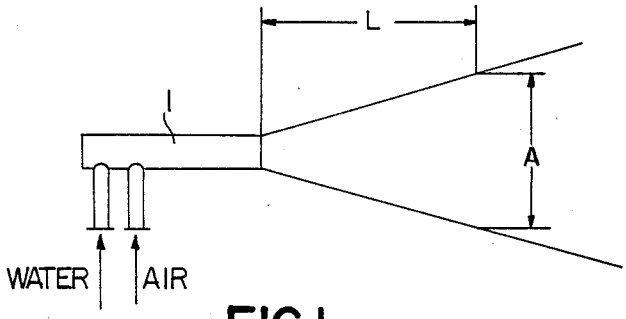
FIG. 1 shows a spray nozzle.

The spray nozzle 1 illustrated in FIG. 1 is of known structure. The cooling fluid, particularly water, is sprayed in a conical pattern onto the preform part being cooled. Air may be added at regulated pressure (e.g., up to 5 bar), thereby increasing the speed and possibly improving the distribution of the water droplets which are sprayed (at the pressure of up to 5 bar), and the air may further be used to regulate the speed of the water droplets). The nozzle enables spraying of a surface with a defined dimension D, disposed at a distance L. The distance from the nozzle to a preformed part is adjusted so as to be able to spray, at an appropriate pressure, a surface region which depends on the dimensions of the preformed part.

Figure 2:
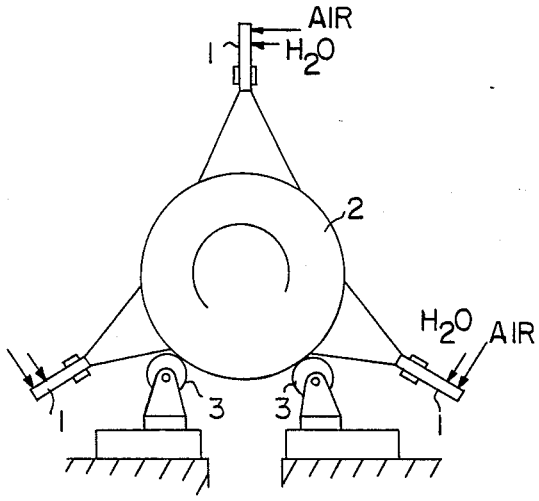
FIG. 2 is a cross section through a first embodiment of a spray device employed in the process.
Figure 3:
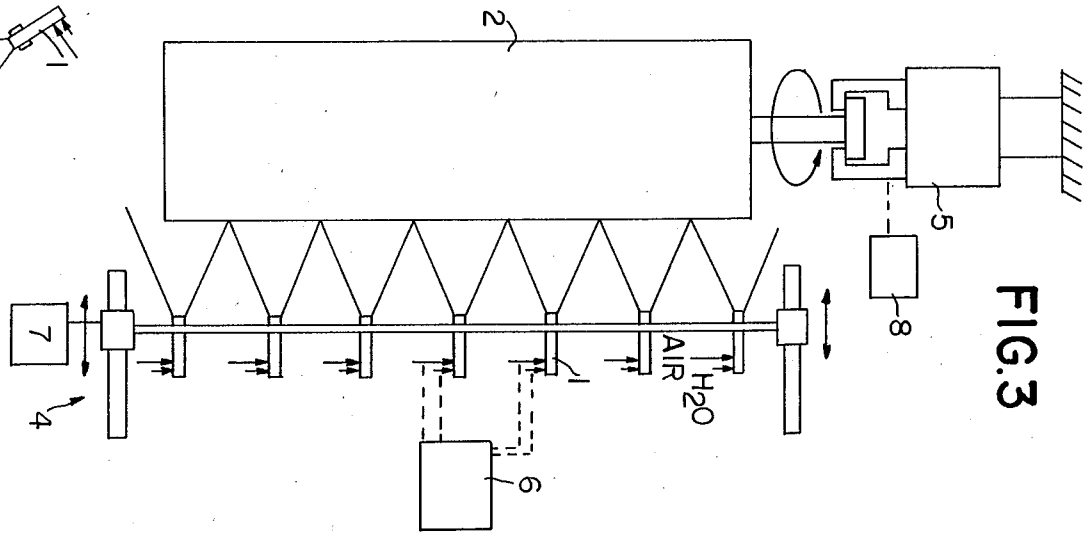
FIG. 3 is a plan view of a second embodiment.

FIG. 2 shows a cylindrical preformed part 2 disposed centrally with respect to three nozzles 1 (or three nozzle strips including assemblies of nozzles 1, as shown in FIG. 3). Part 2 is rotated on rolls 3. The streams of cooling medium strike corresponding surface regions of preformed part 2. The cooling process can be regulated by adjusting the spray angle and/or the rotational speed of preformed part 2.

Figure 4:
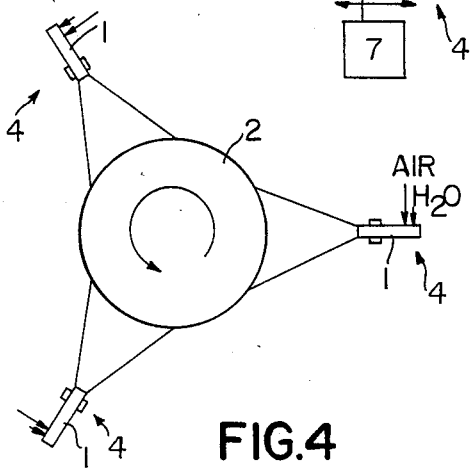
FIG. 4 is a cross section through the embodiment of FIG. 3.

FIG. 3 shows a vertically oriented spray strip 4 having a plurality of nozzles 1. The distance of the nozzles from the cylindrical preformed part adjustable by hand or machine mechanism 7. As seen in FIG. 4, three spray strips 4 are disposed at intervals around the preformed part. Part 2 is suspended on a support device which also rotates it to expose the entire outer surface to the spray. Device 6 regulates the amount and pressure of the spray liquid and compressed air, and the device 8 regulates the rotational speed. Individual devices 5 to 8 are shown only schematically.

Figure 5:
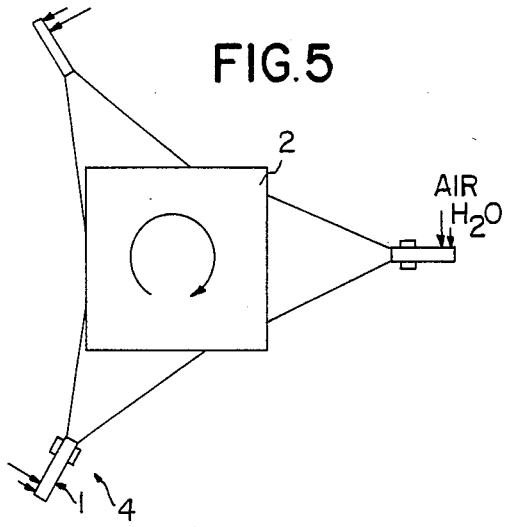
FIG. 5 and 6 show possible dispositions of spray nozzles in spray devices.
Figure 6:
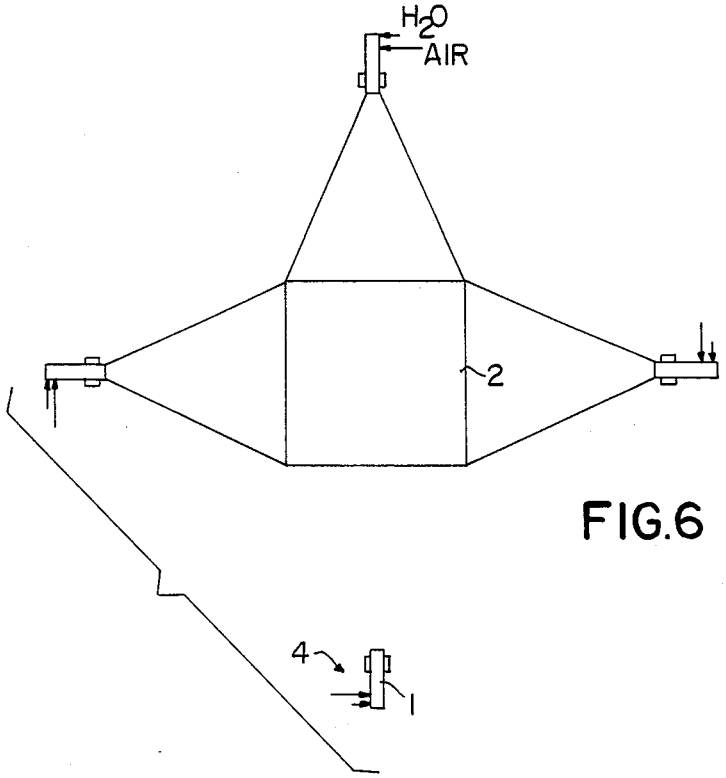

FIGS. 5 and 6 show the arrangement of three or four spray strips having square cross-sections, for cooling a preformed part 2. In this instance as well, the spray parameters are adjusted to the shape of the preformed part and the desired cooling characteristics. With four nozzles, as shown in FIG. 6, it is unnecessary to rotate the material.

For formed preformed parts, the spray parameters of individual nozzles of the spray strip can be adjusted to the longitudinal configuration of the preformed part, so that, for example, regions of lesser diameter will receive less spray, so as to adjust the cooling rate in these regions to that in regions of larger diameter. Adjustment of the spray device to conform to the parameters of various preformed parts can also be accomplished with the use of controlled, intermittent spraying.

EXAMPLE

In a test, an alloy of composition 6.03 percent by weight of Aluminum, 4.03 percent by weight Vanadium, 0.012 percent by weight of Carbon, 74 parts per million Hydrogen, 0.024 percent by weight of Nitrogen, 0.14 percent by weight Oxygen, and 0.14 percent by weight of impurities, with the remainder of the composition being Titanium was melted, and molded parts were produced from it by the disclosed method. Comparison tests were carried out with the molded parts quenched by immersion in water. It turned out that molded parts produced according to the principles of this invention, although having twice the diameter of the water-quenched molded parts, still had a finer grain structure along with correspondingly better characteristic parameters and test performances.

We claim:

1. A method of manufacturing $\alpha+\beta$ Titanium alloys with a content of about six percent by weight of Aluminum, about four percent by weight of Vanadium, and impurities associated with the process, comprising:
   - annealing a molten workpiece of an $\alpha+\beta$ Titanium alloy having a content of about six percent by weight of Aluminum and about four percent by weight of Vanadium, at 1040°–1060° C. to set the $\beta$-phase and produce a preform grain structure with a lamellar matrix of $\alpha+\beta$-phase;
   - converting the grain structure to one of a fine lamellar $\alpha+\beta$-phase and a very fine $\alpha+\beta$-phase during a first cooling step by spraying the workpiece with streams of one of water and an water-air mixture;
   - hot forming the workpiece with a degree of deformation of at least 60% at a temperature of about 850°–1000° C. to produce a high dislocation density;
   - controlling recrystallization of grain structure setting by subjecting the workpiece to a heat treatment at about 950° C. to establish a $\beta$-matrix with a finely divided globulitic $\alpha$-phase;
   - subjecting the workpiece to a subsequent cooling step to achieve substantial martensitic breakdown of the $\beta$-matrix; and
   - subjecting the workpiece to a subsequent annealing step to convert the martensitic matrix to a lamellar $\alpha+\beta$-phase.

2. The method of claim 1, wherein while spraying the workpiece, interrupting of spraying of any surface region of the workpiece is limited to not more than one second in duration.

3. The method of claim 1, further comprised of rotating the workpiece during spraying at between one and twenty revolutions per minute in the path of the streams.

4. The method of claim 1, further comprised of performing the first cooling step by intermittently spraying the workpiece, with the duration of interruptions in the spraying being determined on the basis of a rate of reheating of zones cooled by the spraying.

5. The method of claim 1, wherein the workpiece has a polygonal cross-sectional shape, further comprised of spraying each face of the polygonal cross-sectional shape with a corresponding spray strip during said first cooling step.

6. The method of claim 1, further comprised of conducting the spraying during said first cooling step by simultaneously using at least three spray strips each symmetrically disposed around the workpiece.

7. The method of claim 2, further comprised of rotating the workpiece during spraying at between one and twenty revolutions per minute in the path of the streams.

8. The method of claim 2, further comprised of performing the first cooling step by intermittently spraying the workpiece, with the duration of interruptions in the spraying being determined on the basis of a rate of reheating of zones cooled by the spraying.

9. The method of claim 2, wherein the workpiece has a polygonal cross-sectional shape, further comprised of spraying each face of the polygonal cross-sectional shape with a corresponding spray strip during said first cooling step.

10. The method of claim 2, further comprised of conducting the spraying during said first cooling step by simultaneously using at least three spray strips each symmetrically disposed around the workpiece.

11. The method of claim 3, further comprised of performing the first cooling step by intermittently spraying the workpiece, with the duration of interruptions in the spraying being determined on the basis of a rate of reheating of zones cooled by the spraying.

12. The method of claim 3, wherein rate of cooling of the workpiece during said first cooling step is adjusted by regulating one of water pressure of the streams, rotational speed at which the workpiece is rotated, and duration of interruptions of the streams during spraying.

13. The method of claim 3, wherein the workpiece has a polygonal cross-sectional shape, further comprised of spraying each face of the polygonal cross-sectional shape with a corresponding spray strip during said first cooling step.

14. The method of claim 3, further comprised of conducting the spraying during said first cooling step by simultaneously using at least three spray strips each symmetrically disposed around the workpiece.

15. The method of claim 4, wherein the workpiece has a polygonal cross-sectional shape, further comprised of spraying each face of the polygonal cross-sectional shape with a corresponding spray strip during said first cooling step.

16. The method of claim 4, further comprised of conducting the spraying during said first cooling step by simultaneously using at least three spray strips each symmetrically disposed around the workpiece.

17. The method of claim 7, wherein rate of cooling of the workpiece during said first cooling step is adjusted by regulating one of water pressure of the streams, rotational speed at which the workpiece is rotated, and duration of interruptions of the streams during spraying.

18. A method of manufacturing $\alpha+\beta$ Titanium alloys with a content of about six percent by weight of Aluminum, about four percent by weight of Vanadium, and impurities associated with the process, comprising:

annealing a molten workpiece of an $\alpha+\beta$ Titanium alloy having a content about six percent by weight of Aluminum and about four percent by weight of Vanadium, at 1040°–1060° C. to set the $\beta$-phase and produce a preform grain structure with a lamellar matrix of $\alpha+\beta$-phase;

converting the grain structure to one of a fine lamellar $\alpha+\beta$-phase and a very fine $\alpha+\beta$-phase during a first cooling step by spraying the workpiece with streams of one of water and a water-air mixture;

hot forming the workpiece with a degree of deformation of at least 60% at a temperature between about 30°–50° C. below the transition temperature of the alloy to produce a high dislocation density;

subjecting the workpiece to a second cooling step by spraying the workpiece with streams of one of water and a water-air mixture;

controlling recrystallization of grain structure setting by subjecting the workpiece to a heat treatment at about 950° C. to establish a $\beta$-matrix with a finely divided globulitic $\alpha$-phase;

subjecting the workpiece to a subsequent cooling step to achieve substantial martensitic breakdown of the $\beta$-matrix by spraying the workpiece with streams of one of a water-air mixture; and subjecting the workpiece to a subsequent annealing step to convert the martensitic matrix to a lamellar $\alpha+\beta$-phase.

19. The method of claim 18, further comprised of rotating the workpiece during spraying at between four and ten revolutions per minute in the path of the streams.

20. The method of claim 19, further comprised of:

performing said cooling step by intermittently spraying the workpiece, with the duration of interruptions in the spraying being determined on the basis of a rate of reheating of zones cooled by the spraying with interruption of spraying of any surface region of the workpiece being limited to not more than one second in duration; and adjusting the rate of cooling of the workpiece during said cooling steps by regulating water pressure of the streams, rotational speed at which the workpiece is rotated, and duration of interruptions of the streams during spraying.

* * * * *